US010220428B2

(12) United States Patent
Fujii et al.

(10) Patent No.: US 10,220,428 B2
(45) **Date of Patent: *Mar. 5, 2019**

(54) PRESS FORMING METHOD, AND METHOD FOR MANUFACTURING PRESS-FORMED PART

(71) Applicant: JFE STEEL CORPORATION, Tokyo (JP)

(72) Inventors: Yusuke Fujii, Tokyo (JP); Toyohisa Shinmiya, Tokyo (JP); Eiji Iizuka, Tokyo (JP); Yuji Yamasaki, Tokyo (JP)

(73) Assignee: JFC STEEL CORPORATION, Tokyo (JP)

( * ) Notice: Subject to any disclaimer, the term of this patent is extended or adjusted under 35 U.S.C. 154(b) by 102 days.

This patent is subject to a terminal disclaimer.

(21) Appl. No.: 15/106,724

(22) PCT Filed: Oct. 21, 2014

(86) PCT No.: PCT/JP2014/005348
§ 371 (c)(1),
(2) Date: Jun. 20, 2016

(87) PCT Pub. No.: WO2015/092963
PCT Pub. Date: Jun. 25, 2015

(65) Prior Publication Data

US 2017/0028455 A1 Feb. 2, 2017

(30) Foreign Application Priority Data

Dec. 20, 2013 (JP) ..... 2013-263993

(51) Int. Cl.
*B21D 22/26* (2006.01)
*B21D 53/88* (2006.01)

(52) U.S. Cl.
CPC ..... *B21D 22/26* (2013.01); *B21D 53/88* (2013.01)

(58) Field of Classification Search
CPC ..... B21D 22/22; B21D 22/26; B21D 53/88
See application file for complete search history.

(56) References Cited

U.S. PATENT DOCUMENTS 5,901,599 A 5/1999 Sato et al.
6,276,185 B1 8/2001 Owens
(Continued)

FOREIGN PATENT DOCUMENTS

CN 101209470 A 7/2008
CN 201815594 U 5/2011
(Continued)

OTHER PUBLICATIONS

Dec. 14, 2016 Search Report issued in European Patent Application No. 14871958.6.
(Continued)

*Primary Examiner* — Debra Sullivan
(74) *Attorney, Agent, or Firm* — Oliff PLC

(57) ABSTRACT

A press forming method forms a metal plate into the part shape having at least a top surface portion and side wall portions continuous with both left and right sides of the top surface portion, the part shape having a U-shaped or hat-shaped cross section and having one or two or more bent portions bent in a longitudinal direction that is a direction intersecting the cross section. The press forming method includes: a first step of applying in-plane shear deformation to a plate portion on both sides or one side of the bent portions in the longitudinal direction of the metal plate, the in-plane shear deformation corresponding to a direction of bending the portion of the part shape; and a second step of implementing press forming for the metal plate into the part shape, the metal plate to which the in-plane shear deformation has been applied.

11 Claims, 16 Drawing Sheets

(56) References Cited

U.S. PATENT DOCUMENTS

| | | | |
|---|---|---|---|
| 2008/0053184 | A1 | 3/2008 | Knaup |
| 2013/0213109 | A1 | 8/2013 | Ogasawara |

FOREIGN PATENT DOCUMENTS

| | | | |
|---|---|---|---|
| JP | H09-29349 | A | 2/1997 |
| JP | 2004-154786 | A | 6/2004 |
| JP | 2004-314123 | A | 11/2004 |
| JP | 2008-012570 | A | 1/2008 |
| JP | 2008-018442 | A | 1/2008 |
| JP | 2008-18842 | A | 1/2008 |
| JP | 2009-241109 | A | 10/2009 |
| JP | 2012-051005 | A | 3/2012 |
| JP | 2013-169578 | A | 9/2013 |

OTHER PUBLICATIONS

Jan. 20, 2015 International Search Report issued in International Patent Application No. PCT/JP2014/005348.
Jan. 20, 2015 Written Opinion issued in International Patent Application No. PCT/JP2014/005348.
Aug. 17, 2017 Office Action issued in Korean Patent Application No. 10-2016-7016422.
Mar. 2, 2017 Office Action issued in Chinese Patent Application No. 201480069801.1.

A-A CROSS SECTION

B-B CROSS SECTION

C-C CROSS SECTION

EXCESS AND SHORTAGE OF LENGTH OF METAL PLATE

DEFORMATION REQUIRED FOR LONGITUDINAL WALL PORTION

BEFORE MOLDING

AFTER MOLDING

PRESS FORMING METHOD, AND METHOD FOR MANUFACTURING PRESS-FORMED PART

TECHNICAL FIELD

The present invention relates to a press forming method of forming a metal plate into a part shape, such as a U shape or a hat shape, which has a cross-sectional shape including at least a top surface portion and side wall portions on both sides thereof in a width direction, and has a bent portion bent in a longitudinal direction that is a direction intersecting such a cross section, for example, perpendicular to the cross section, and relates to a method for manufacturing a press-formed part.

Particularly, the present invention relates to a technology suitable for forming a metal plate, such as a high-tensile steel plate and an aluminum alloy plate with a tensile strength of 590 MPa or more, which is composed of a difficult-to-form member poor in ductility and Lankford value, into the part shape having the bent portion in the longitudinal direction.

BACKGROUND ART

Many metal parts for use in an automobile and a home appliance are made by deforming flat metal plates into a variety of shapes. In a case of mass-producing such a metal part, a press forming method of deforming the metal plate by using a press machine and a metal die is widely used. In usual, the metal plate before being machined is flat, and accordingly, in a case of deforming the metal plate into a complicated three-dimensional shape, the metal plate expands and contracts to a shape in match with the three-dimensional shape. However, as a part shape (the three-dimensional shape) becomes more complicated, it becomes more difficult to give the expansion and the contraction, which are allowed to correspond to the three-dimensional shape, to the metal plate. In particular, in a case where the metal plate for use is a high-tensile steel plate or an aluminum alloy plate with a tensile strength of 590 MPa or more, and in a case where the metal plate is a difficult-to-form member poor in ductility and Lankford value, it tends to be difficult to form the metal plate into a free three-dimensional shape.

In a case where the metal plate cannot be given the expansion and contraction in match with the three-dimensional shape in an event of the press forming, such a forming defect as a crack and a wrinkle occurs in the metal plate. For example, in an event where the metal plate is deformed to the three-dimensional shape, the metal plate cannot help expanding more than necessary in a region in which a length of the metal plate falls short and an amount of shortage cannot be compensated from a periphery thereof, and as a result, the crack occurs when the metal plate is pulled beyond ductility thereof. Meanwhile, in a case where the length of the metal plate must decrease in the event where the metal plate is deformed to the three-dimensional shape, and in a region into which a material flows excessively from a periphery in that event, the wrinkle is prone to occur in a press-formed part already obtained by the forming.

As an example of a part shape for which it is difficult to perform the press forming, as illustrated in FIG. 1 and FIG. 2, there is a part shape, in which a cross-sectional shape is a U shape or a hat shape, the part shape having a bent portion in a direction intersecting such a cross section perpendicularly (that is, a longitudinal direction of the part; hereinafter, sometimes simply referred to as a longitudinal direction). In a case of forming the flat metal plate into such a complicated part shape, the crack and the wrinkle are prone to occur in the press-formed part, which is already obtained by the forming, due to tensile deformation and compression deformation, which occur in the above-described bent portion.

Here, as a method for suppressing the occurrence of the crack and the wrinkle in the press forming, there is a method of forming the metal plate while applying tension thereto by sandwiching the metal plate by metal dies as in draw forming. In this method, when the tension applied to the metal plate is increased, it becomes difficult for the metal plate to flow into a three-dimensional shape portion excessively, and the occurrence of the wrinkle can be prevented. On the contrary, when the tension applied to the metal plate is decreased, it becomes easy for the metal plate to flow into the three-dimensional shape portion, and the occurrence of the crack can be prevented.

Then, PTL 1 proposes to change the tension, which is required during the forming, appropriately by using an embossed shape called beads. Moreover, PTL 2 proposes to enhance rigidity of end portions in the width direction of the metal plate, to thereby enhance resistance of the metal plate to contraction deformation when the metal plate is flown, and to suppress the occurrence of the wrinkle.

Citation List

Patent Literature

PTL 1: JP H09-29349 A
PTL 2: JP 2013-169578 A

SUMMARY OF INVENTION

Technical Problem

In the method described in PTL 1, in order to change the tension applied to the metal plate, it is necessary to provide a mechanism, which controls pressing force of the variable beads, in a draw forming device. Therefore, in the method described in PTL 1, manufacturing cost of the forming device is increased. Moreover, in general, the high-tensile steel plate, the aluminum alloy and the like are poor in Lankford value indicating drawing formability, and accordingly, there are limitations in forming the complicated three-dimensional shape by the usual draw forming.

Moreover, in the method described in PTL 2, in the part bent in the longitudinal direction, high-rigidity portions which resist the contraction deformation are provided in flange portions, whereby wrinkles, which occur in the flange portions due to metal excess caused by the bent shape, are suppressed. However, the method described in Patent Literature 2 does not serve as an effective solution method for a case where the wrinkles occur in portions other than the flange portions, for example, in side wall portions and a top surface portion. Moreover, the above-described metal excess occurs by the fact that a part of the metal plate remains excessively in an event of attempting to deform the metal plate with a flat shape into the complicated bent shape. Therefore, in the method described in PTL 2, there is a problem that it is apprehended that, unless the excess and shortage of the metal plate, which occur not only in the flange portions but also in the entirety of the part shape, are considered, the forming defect such as the wrinkle and the crack may occur in other regions.

The present invention has been made by focusing on the points as described above, and it is an object of the present invention to provide a technology capable of further suppressing the occurrence of the crack and the wrinkle in the event of forming the metal plate into the part shape having the cross-sectional shape such as the U shape and the hat shape and having the bent portion in the longitudinal direction.

Solution to Problem

In order to solve the above-described problems, an aspect of the present invention is a press forming method for forming a metal plate into a part shape having at least a top surface portion and side wall portions continuous with both left and right sides of the top surface portion, the part shape having a U-shaped or hat-shaped cross section and having one or two or more bent portions bent in a longitudinal direction that is a direction intersecting the cross section. The aspect of the present invention is characterized by including: a first step of applying in-plane shear deformation to a plate portion on both sides or one side of the bent portions in the longitudinal direction of the metal plate, the in-plane shear deformation corresponding to a direction of bending the portion of the part shape; and a second step of implementing press forming for the metal plate to which the in-plane shear deformation has been applied, into the part shape.

Moreover, another aspect of the present invention is a method for manufacturing a press-formed part by forming a metal plate into a part shape having at least a top surface portion and side wall portions continuous with both left and right sides of the top surface portion, the part shape having a U-shaped or hat-shaped cross section and having one or two or more bent portions bent in a longitudinal direction that is a direction intersecting the cross section. The another aspect of the present invention is characterized by including: a first step of applying in-plane shear deformation to a plate portion on both sides or one side of the bent portions in the longitudinal direction of the metal plate, the in-plane shear deformation corresponding to a direction of bending the portion of the part shape; and a second step of implementing press forming for the metal plate to which the in-plane shear deformation has been applied, into the part shape.

Advantageous Effects of Invention

In accordance with the present invention, the in-plane shear deformation is applied in advance to the metal plate in the first step, and thereafter, the metal plate is subjected to the press forming into the target part shape in the second step.

In such a way, as a result that the excessive movement of the material in the bent portions is suppressed, it becomes possible to suppress the occurrence of the cracks and the wrinkles in the event of forming the metal plate into the complicated plate shape having the cross-sectional shape such as the U shape and the hat shape and having the bent portions in the longitudinal direction intersecting the cross section.

BRIEF DESCRIPTION OF DRAWINGS

FIG. 2A is an A-A cross-sectional view, FIG. 2B is a B-B cross-sectional view, and FIG. 2C is a C-C cross-sectional view.

FIG. 4B illustrates where the first step is implemented.

FIG. 9A is a view viewed from a plate width direction, and FIG. 9B is a view viewed from the longitudinal direction.

FIG. 10A is a view explaining a state of the grid before the forming, and FIG. 10B is a view explaining a state of the grid after the forming.

FIG. 12A illustrates a state before the forming, and FIG. 12B illustrates a state after the forming.

FIG. 13A is a view viewed from the plate width direction, and FIG. 13B is a view viewed from the longitudinal direction.

DESCRIPTION OF EMBODIMENTS

Next, a description is made of an embodiment of the present invention with reference to the drawings.

We, the inventors of the present invention, conducted the following study for a press method capable of forming a metal plate for use into a part shape 1 (press-formed part) as illustrated in FIGS. 1A to 1C and FIGS. 2A to 2C without causing a crack and a wrinkle in the part shape 1 in an event of forming and manufacturing the metal plate into the part shape 1 even if the metal plate is a difficult-to-form member such as a high-tensile steel plate and an aluminum alloy plate, which is poor in ductility and Lankford value.

Figure 1A:
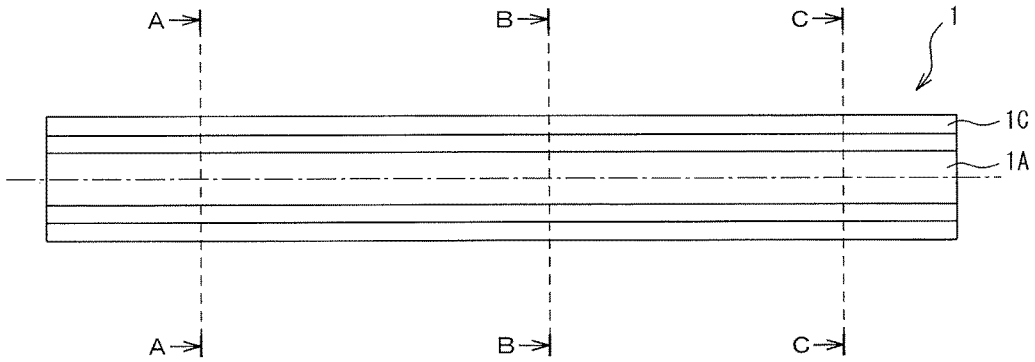
FIGS. 1A to 1C are views illustrating a part shape according to an embodiment of the present invention. FIG. A is a plan view, FIG. B is a side view; and FIG. C is a perspective view viewed obliquely from above in a longitudinal direction.
Figure 1B:
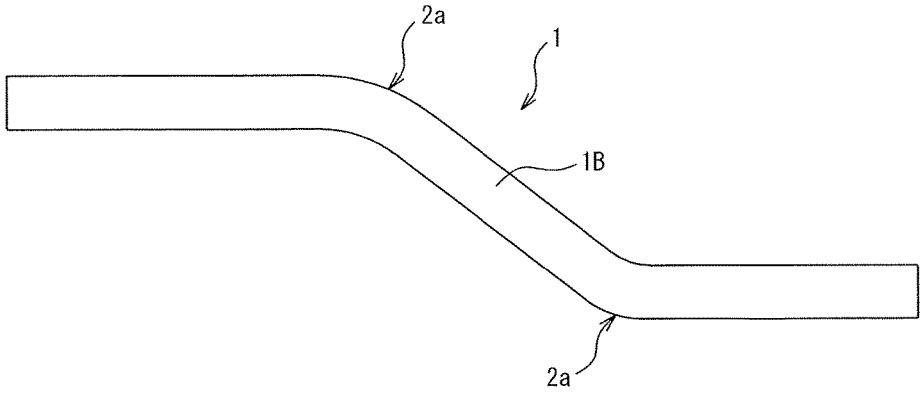
Figure 1C:
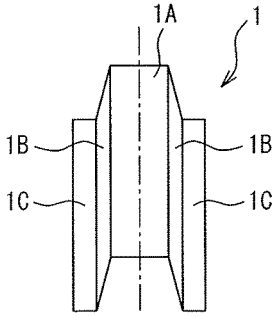
Figure 2A:
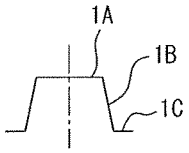
FIGS. 2A to 2C are views illustrating respective cross sections in FIG. 1.
Figure 2B:
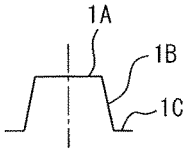
Figure 2C:
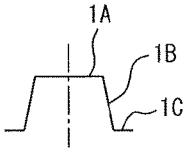
Figure 3:
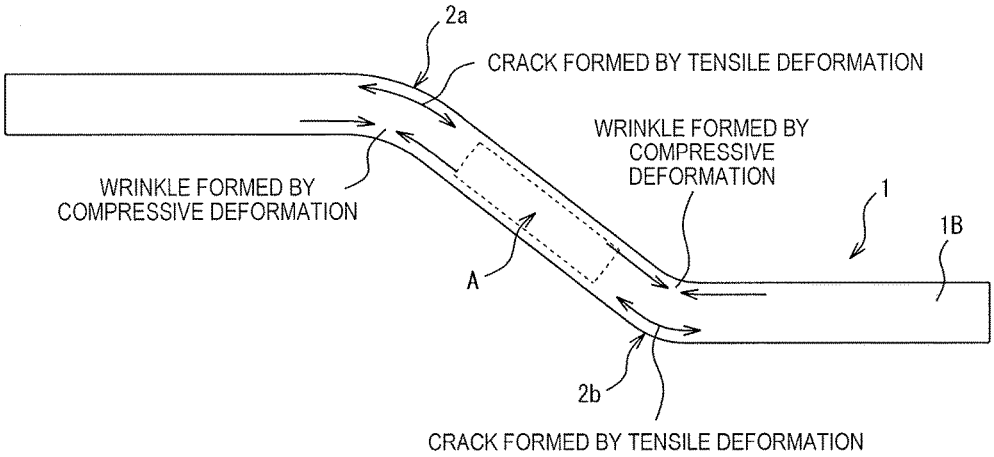
FIG. 3 is a side view explaining forming defects as wrinkles and cracks.
Figure 4A:
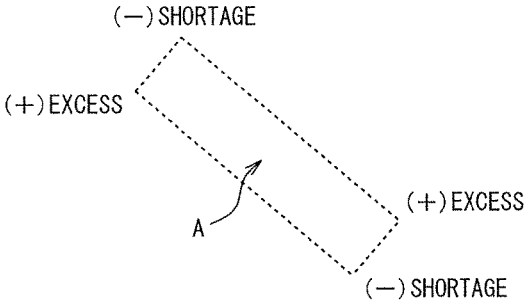
FIGS. 4A and 4B are views explaining excess and shortage of a length of a metal plate. FIG. A illustrates a case where a first step is not implemented.
Figure 4B:
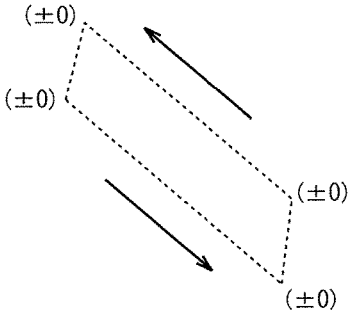

That is to say, in a case of forming a flat metal plate into the part shape 1 as illustrated in FIGS. 1A to 1C by single press forming, tensile deformation and compressive deformation, which are as illustrated in FIG. 3, occur in respective bent portions in a longitudinal direction, and cause such cracks and wrinkles. When the tensile deformation and the compressive deformation, which cause such forming defects of FIG. 3, are considered while taking, as a reference, a side wall portion A between bent portions 2*a* and 2*b* adjacent to each other, excess and shortage of a length of the metal plate occur on a periphery of the side wall portion A as illustrated in FIG. 4A. When the metal plate can be deformed in advance so that these excess and shortage of the metal plate cannot occur, the forming defects do not occur. From this matter, the inventors of the present invention reached a conclusion that the material just needs to move from a region where the length of the metal plate is excessive toward a region where the length falls short as illustrated in FIG. 4B. That is to say, the inventors reached a conclusion that shear deformation in a plate surface (that is, in-plane shear deformation) just needs to be applied in advance to the metal plate of the side wall portion A. Moreover, in a case where such phenomena as described above occur in a top surface portion 1A, such in-plane shear deformation as described above just needs to be applied in advance to the top surface portion 1A.

That is to say, the inventors of the present invention found out that, after a step of generating the in-plane shear deformation in the metal plate is implemented in advance in response to a direction of longitudinal bending owned by the part shape 1 as a target, the metal plate is formed into the part shape 1 as a target by a general press forming method such as foam forming and draw forming, whereby excessive movement of the material in the bent portions is suppressed. In such a way, in an event of forming the metal plate into the part shape 1 having a cross-sectional shape such as a U shape and a hat shape and having the bent portions in the longitudinal direction, it becomes possible to suppress the occurrence of the cracks and the wrinkles for the part shape 1.

As described above, press working is performed based on the present invention, whereby it becomes possible to suppress the cracks and the wrinkles, which may have occurred heretofore, even in an event of forming a part such as an automotive part, which is bent three-dimensionally in the longitudinal direction, by the press working. In particular, the present invention is suitable for manufacturing the press-formed part formed by using, as the metal plate, the difficult-to-form member such as the high-tensile steel plate and the aluminum alloy plate with a tensile strength of 590 MPa or more.

"Press Method"

The part shape 1 (press-formed part), which is already obtained by the press forming, has a U-shaped cross-sectional shape including at least the top surface portion 1A and side wall portions 1B continuous with both left and right sides thereof in a width direction, or has a hat-shaped cross-sectional shape further including flange portions 10 on outer peripheries of the side wall portions 1B. Moreover, the above-described part shape 1 has bent portions on one spot or two or more spots in the longitudinal direction that is a direction intersecting the above-described cross section (plate width direction).

In this embodiment, the description is made while taking, as an example, a case of forming the metal plate into such a part shape 1, which has the hat shape in cross section and includes two bent portions 2*a* and 2*b*, as the target part shape 1 already obtained by the forming. That is to say, the part shape 1 of this embodiment is one in a case where the cross section thereof has the hat shape, and two bent portions are provided in the longitudinal direction, the two bent portions being: the first portion 2*a* in which the top surface portion 1A is bent to protrude; and the second portion 2*b* in which the top surface portion 1A is bent to be recessed. However, the bent portions may be provided on one spot or three spots or more. Moreover, even if the bent portions are provided on two spots, both of the bent portions on the two spots adjacent to each other may have a shape curved in the same direction.

Then, the press forming method of this embodiment includes the following two steps, which are a first step and a second step.

In the first step, for a flat metal plate 6 (refer to FIG. 5, FIG. 6), the in-plane shear deformation, which corresponds to such a bending direction as described above, is applied to both-side plate portions or one-side plate portion of each of the above-described bent portions 2*a* and 2*b* in a longitudinal direction of the metal plate 6. As mentioned above, the bending in the longitudinal direction in this embodiment is mainly in the case of the shape bent in a plate thickness direction of the top surface portion 1A, and accordingly, portions to which the above-described in-plane shear deformation has been applied in the first step are defined to be the left and right side wall portions 1B. Moreover, in this embodiment, the case where the in-plane shear deformation is applied to one side in the longitudinal direction of the bent portion is illustrated as an example; however, the in-plane shear deformation may be applied to both sides in the longitudinal direction of the bent portion.

Here, in a case where the bending in the longitudinal direction in the part shape 1 as a target serves for a shape bent in the width direction (plate thickness direction of the side wall portions 1B), the forming just needs to be implemented so that the in-plane shear deformation can be applied to the top surface portion 1A. That is to say, such a plate portion to which the in-plane shear deformation has been applied just needs to be decided as appropriate in response to the direction of the bending to the width direction, the bending going along the longitudinal direction.

The forming of the first step is performed by, for example, the draw forming.

In the second step, such a plate material subjected to the above-described in-plane shear deformation in the first step is press-formed into the part shape 1 as a target by the general press forming method such as the foam forming and the draw forming.

"First Step"

Figure 5:
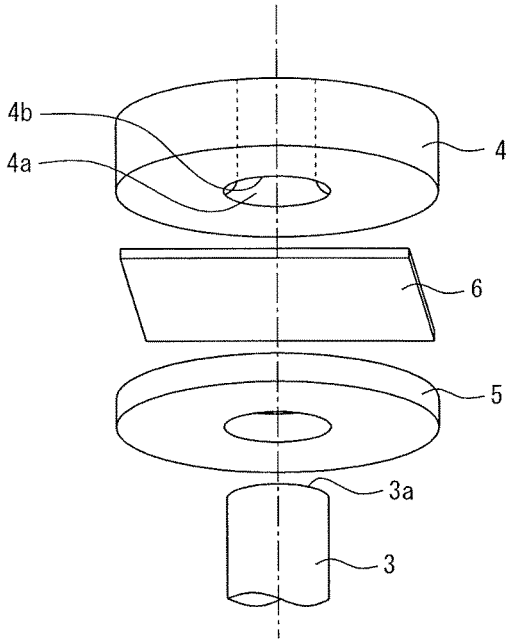
FIG. 5 is a conceptual view illustrating a metal die for use in the first step.
Figure 6:
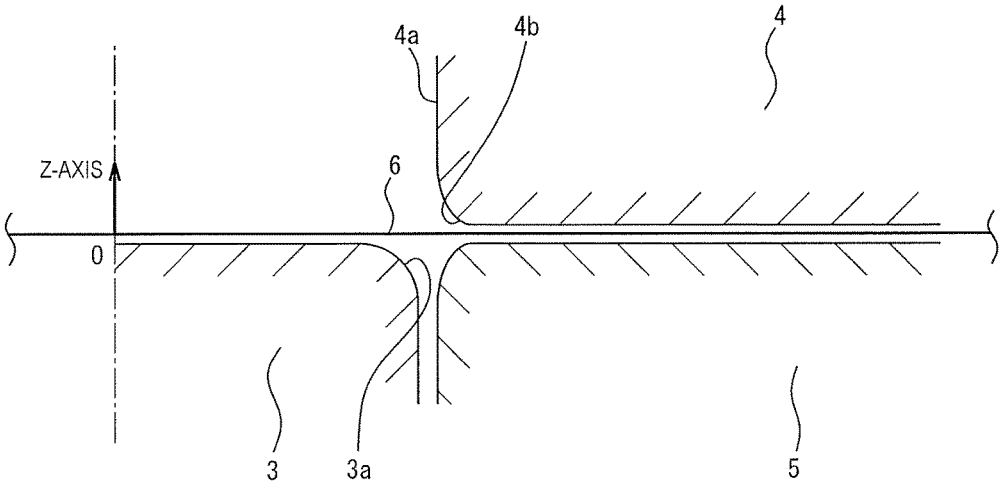
FIG. 6 is a view explaining the metal die illustrated in the first step.

In the first step, as illustrated in FIG. 5 and FIG. 6, a metal die is used, which includes: a columnar punch 3 with a circular cross section; and a die 4 in which a die hole 4*a* allowing the punch 3 to pass therethrough is opened. A shape of the die hole 4*a* is made the same as a shape of the punch 3. An opening portion of the die hole 4*a* becomes a shoulder portion of the die 4.

Figure 7:
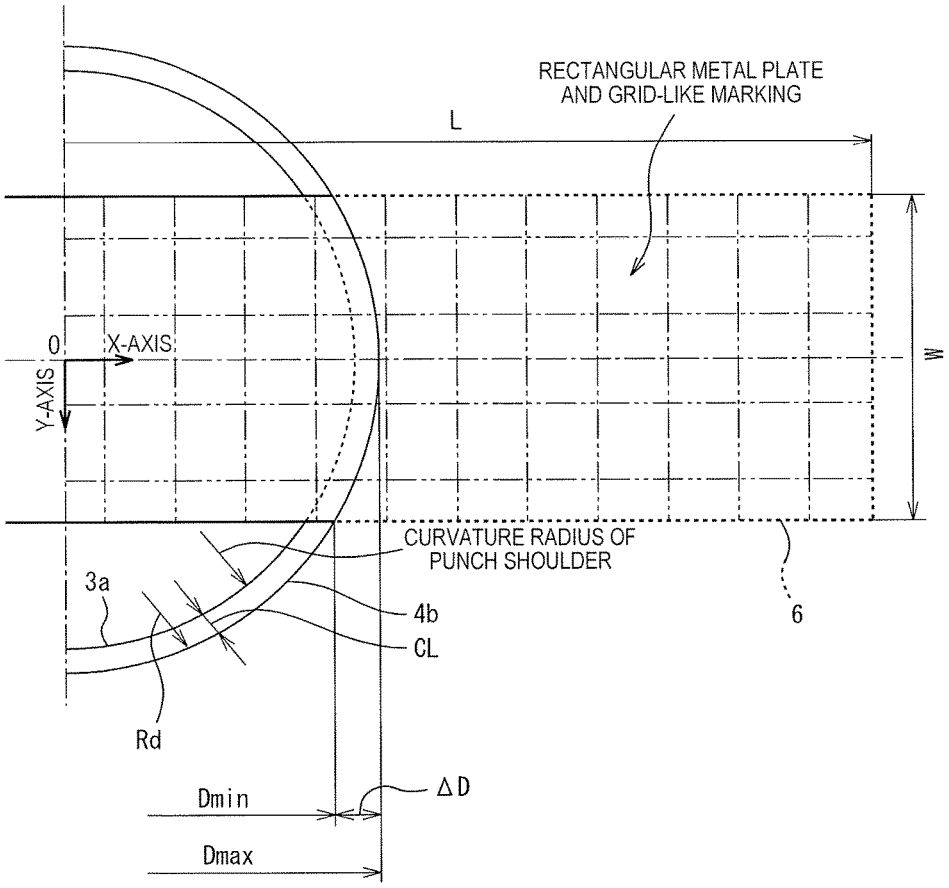
FIG. 7 is a plan view illustrating a relationship between the metal die and a metal plate.

A profile (an outer circumferential outline shape of an upper end surface of the punch 3 in FIG. 5 and FIG. 6) of the above-described punch 3, which goes along a circumferential direction of a shoulder portion 3*a* thereof, is circular as illustrated in FIG. 7, and a diameter of this circle is set larger than a plate width of the metal plate 6. Note that the diameter of the circle of the shoulder portion 3*a* of the punch 3 may be substantially the same as the plate width of the metal plate 6 in terms of dimension or may be smaller than the plate width in response to working conditions for the metal plate 6.

Then, first, the metal plate 6 is placed on the die 4. At this time, as illustrated in FIG. 7 that is a plan view, the metal die is adjusted so that a center of the upper end surface of the circular shape in the above-described punch 3 can be located on a center in the width direction of the metal plate 6, and that the plate portion of the metal plate 6, with which the shoulder portion 3*a* of the punch 3 abuts, can be located on the position of the protruding-side bent portion 2*a* in the target shape. Moreover, a wrinkle holder 5 is placed on a metal plate portion located on an outer circumference of the die hole 4*a*, and the metal plate 6, which is located on an outer circumference of a passing position of the punch 3, is set to a held state. The holding of the metal plate 6 by the wrinkle holder 5 is set to a guide state to an extent where the metal plate 6 is movable toward the punch 3 side without causing the wrinkle as the punch 3 is going up.

Subsequently, the punch 3 is raised to implement the draw forming. Preferably, a rising amount of the punch 3 is set to a length between the two bent portions 2*a* and 2*b* in the above-described longitudinal direction.

In such away, bending in a protruding direction is added to the first bent portion 2*a* that protrudes, and bending in a recessed direction is added to the second bent portion 2*b* that is recessed. Moreover, as will be described later, to a portion, which is located between the first bent portion 2*a* that protrudes and the second bent portion 2*b* that is recessed, and becomes the side wall portion 1B, shear deformation that goes along the bending direction is added sequentially and continuously toward the longitudinal direction as the punch 3 is going up.

Figure 8A:
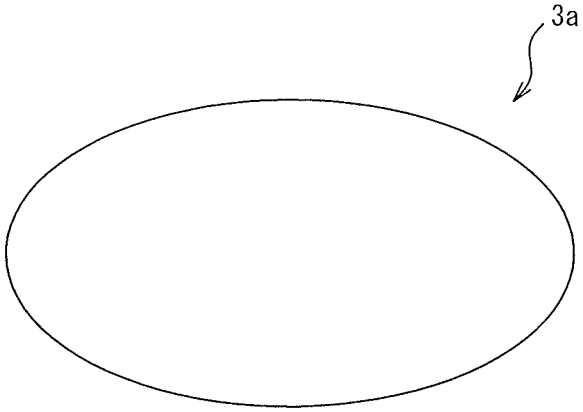
FIGS. 8A and 8B are views illustrating other examples of a profile of a shoulder portion of a punch.
Figure 8B:
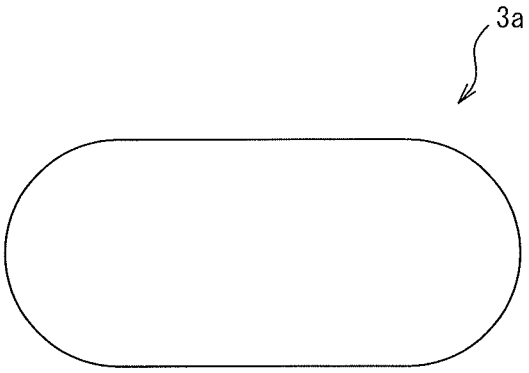

In this embodiment, the metal plate 6 is formed into a bilaterally symmetric shape with respect to the center position of the upper end surface of the punch 3, which is taken as a boundary, and is cut (trimmed) in the plate width direction at the center position of the upper end surface of the punch 3, and is thereby divided into two press-formed parts. In a case where a length of a left side in the longitudinal direction (that is, a side in a direction opposite to the second bent portions 2*a* and 2*b* which are recessed) from the first bent portion 2*a* that protrudes is longer than a radius of the punch 3, then as the punch 3, punches with other cross-sectional shapes as illustrated in FIGS. 8A and 8B, such as an ellipsoidal shape in cross section (FIG. 8A) and a shape in which a rectangular portion is present between left and right circular arcs (FIG. 8B), are used, whereby a length from such a protruding first bent portion 2*a* toward the left side in the longitudinal direction just needs to be ensured. That is to say, in this embodiment, in the profile of the punch 3, there are no limitations in shapes thereof in portions other than the portion bent in such a manner that the punch 3 abuts against the metal plate 6.

The flat metal plate 6 to be worked is defined to have a rectangular shape as illustrated in FIG. 7. In the description of this embodiment, with regard to coordinates in an event of the description, a center portion of the metal plate 6, which is opposed to the center of the upper end surface of the punch 3, is defined as an origin O, the longitudinal direction of the metal plate 6 is defined as an X-axis, the plate width direction of the metal plate 6 is defined as a Y-axis, and the plate thickness direction (a stroke direction of the punch 3) is defined as a Z-axis.

Next, examples of the metal plate 6 and conditions of the draw forming are illustrated.

The metal plate 6 of this embodiment is rectangular, and is a plate material with a width W equal to 100 mm, a length L equal to 800 mm, and a plate thickness equal to 1.0 mm, and a material of the metal plate 6 is a 1180 MPa-class cold-rolled steel sheet. All of the punch 3, the die 4 and the wrinkle holder 5 are cylindrical, a curvature radius Rd of the die hole 4*a* (that is, a curvature radius of the die shoulder) is set to 90 mm, a clearance CL (a gap between the punch 3 and the die 4 (that is, a difference between a shoulder radius of the punch 3 and a radius of the die hole 4*a*)) is set to 1.0 mm in the same way as the plate thickness of the metal plate 6, and a wrinkle holding load is set to 10 tonf at which the wrinkles are assumed not to occur in the metal plate 6.

Then, the punch 3 is moved in a Z-axis direction (an up-and-down direction in this embodiment) as mentioned above, whereby the plate portion of the metal plate 6, which is sandwiched by the die 4 and the wrinkle holder 5, flows into the gap between the punch 3 and the die 4 while being bent continuously on the die shoulder portion, and while moving in the X-axis direction (punch 3 side) and the Z-axis direction. At this time, since the metal plate 6 is flat while a center side of the shoulder portion 3*a* of the punch 3 protrudes relatively, a center side in the width direction (that is, a first loaded portion) in a portion of the metal plate 6, which abuts against the shoulder portion 3*a* of the punch 3, is pulled strongly on the shoulder portion 3*a*. Meanwhile, in a shoulder portion 4*b* of the die 4 (that is, an outer circumference of an opening end portion of the die hole 4*a*), left and right sides thereof in the plate width direction protrude relatively to the punch side, and accordingly, plate portions of the metal plate 6, which are located on the shoulder portion 4*b* of the die 4, are pulled strongly on both sides (second loaded portions) thereof in the width direction while being bent. Therefore, the portions which become the side wall portions are subjected to the draw forming while being pulled in directions which connect the first loaded portion and the second loaded portions, that is, oblique directions inclined to both of the plate width direction and the longitudinal direction. Note that, in this example, as the punch 3 is moving, positions of the second loaded portions in the metal plate (that is, positions which abut against the die shoulder portion) move to the second bent portion 2*b* side that is recessed.

Here, in order to facilitate visual understanding as to how the metal plate 6 is deformed before and after the forming, grid-like marking, each square of which has a regular square shape, is written on a surface of the unworked metal plate 6 as illustrated in FIG. 7.

Figure 9A:
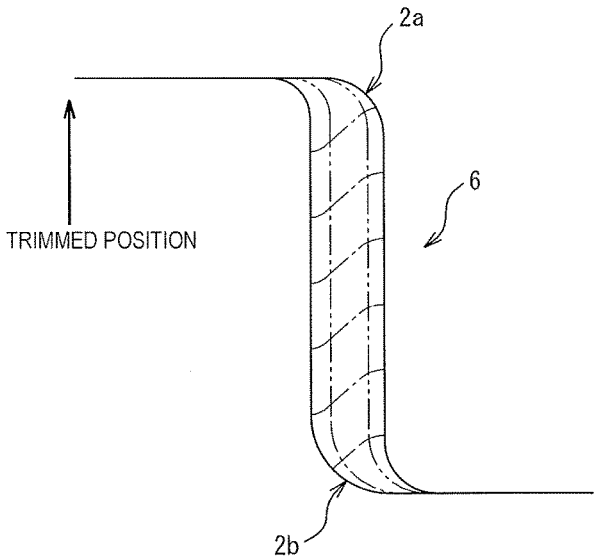
FIGS. 9A and 9B are views illustrating a formed article of the metal plate, which is obtained by draw forming by the first step.
Figure 9B:
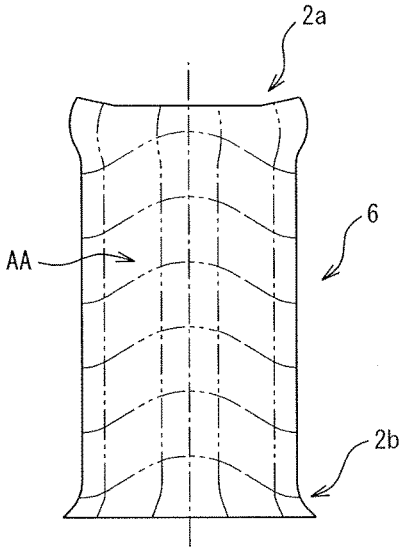

The rectangular metal plate 6 was subjected to the draw forming by using the above-described metal die, and a formed article thus obtained was trimmed on a center portion thereof (the portion that abutted against the center portion of the punch 3), and as a result, the forming defects such as the cracks and the wrinkles did not occur, and such a formed article as illustrated in FIGS. 9A and 9B was obtained.

Figure 10A:
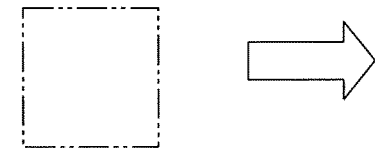
FIGS. 10A and 10B are views illustrating deformation of a grid AA on the metal plate.
Figure 10B:
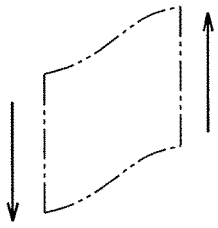

As a result of observing this formed article, it was able to be confirmed that the metal plate portion (portions between the two bent portions 2*a* and 2*b*), which passed the shoulder portion of the die 4, caused the in-plane shear deformation, and in particular, between the center of the plate width and the end portions thereof as in a grid AA (refer to FIGS. 9A and 9B), such large in-plane shear deformation as illustrated in FIGS. 10A and 10B occurred. Moreover, in this draw forming, unlike general draw forming, compressive deformation in the circumferential direction in a curved line (profile) of the shoulder portion of the die 4 does not occur much, and accordingly, this embodiment is suitable for application to the difficult-to-form member poor in drawing formability (Lankford value).

Next, a reason why the above-described in-plane shear deformation occurs is described in detail by using the shape of the metal die illustrated in FIG. 5 to FIG. 7.

Figure 11:
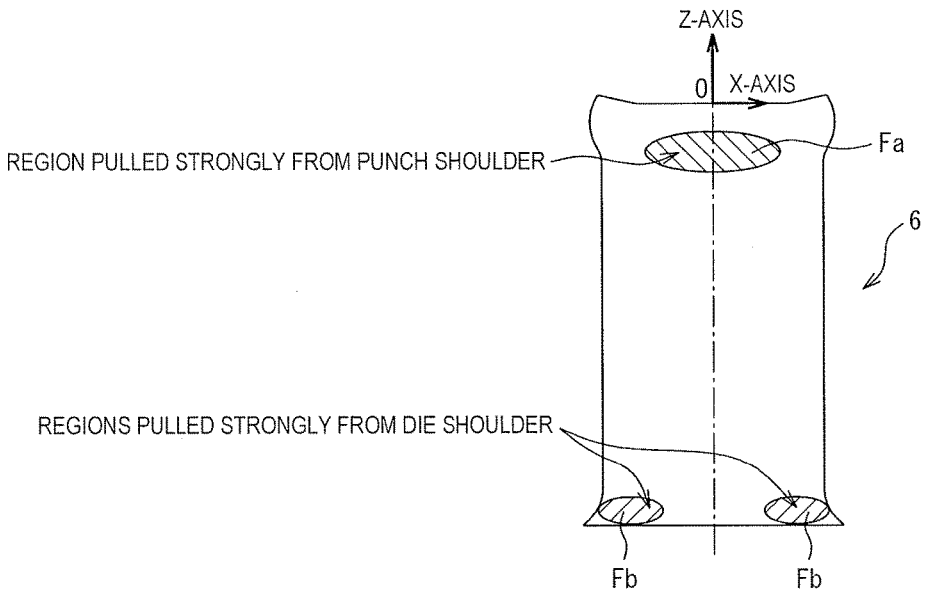
FIG. 11 is a view viewed from a longitudinal direction, illustrating a region in which the metal plate is pulled strongly.

In a case where a distance from a ZY plane to the shoulder portion 3*a* of the punch 3 differs in the width direction of the metal plate 6, such a center portion (the first loaded portion Fa) of the shoulder portion of the punch 3, which is located at a position farthest from such a YZ plane in the X-axis direction, pulls the metal plate 6 strongly. Meanwhile, when the die 4 side is focused, such outer circumference sides (the second loaded portions Fb) of the shoulder portions of the die hole 4*a*, which are located at positions closest to the YZ plane in the Y-axis direction, pull the metal plate 6 strongly. Hence, the center portion of the metal plate 6 receives relatively large tension by the punch 3, and the end portions in the width direction of the metal plate 6 receive relatively large tension by the die 4. FIG. 11 illustrates regions in which the rectangular metal plate 6 receives the tension from the punch 3 and the die 4 in a course of the forming in the first step. As a result, the metal plate 6 that passes from the portion of the wrinkle holder 5 to the shoulder of the die 4 is pulled from three spots as in FIG. 12A, and accordingly, is deformed as in FIG. 10B.

As described above, in the first step, the metal plate 6 is subjected to the draw forming by using the above-described metal die, whereby the shear deformation is applied to at least the side wall portions 1B so that tensile force can be generated between the first loaded portion Fa located at the top surface portion 1A and the second loaded portions Fb which are located at the plate portions apart from the first loaded portion Fa in the above-described longitudinal direction and more on the outside in the plate width direction from the positions becoming the side wall portions 1B.

In particular, in this embodiment, the positions of the second loaded portions Fb move continuously as the punch is moving, whereby, even if the two bent portions 2*a* and 2*b* are apart from each other, it becomes possible to more surely apply the shear deformation to the plate material along the longitudinal direction.

Figure 12A:
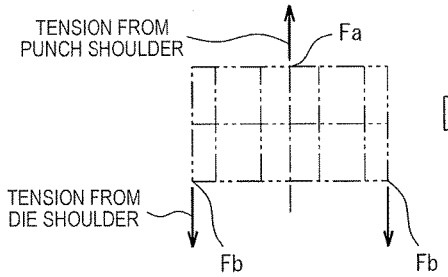
FIGS. 12A and 12B are views explaining deformation to which the metal plate is subjected by tensile force.
Figure 12B:
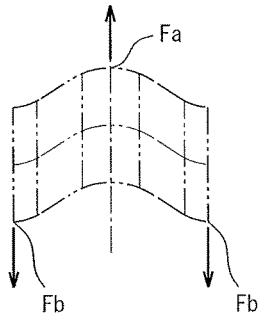

In the example illustrated in FIGS. 12A and 12B, the center position in the width direction of the top surface portion 1A corresponds to the first loaded portion Fa, and the second loaded portions Fb are located on the outer end portions in the width direction, that is, the left and right flange portions 10. As a result that the first loaded portion Fa and the second loaded portion Fb are pulled most strongly, a tensile load is applied to the metal plate 6 obliquely with respect to the longitudinal direction, whereby the in-plane shear deformation occurs.

Figure 13A:
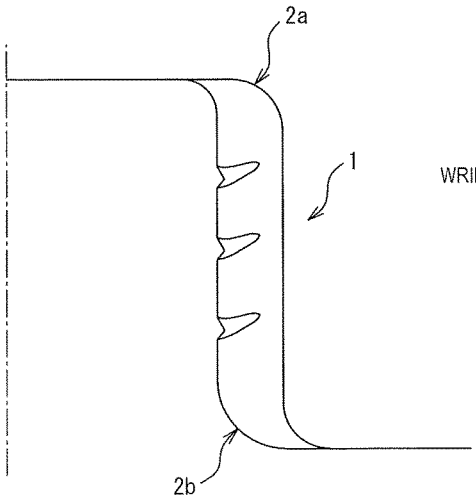
FIGS. 13A and 13B are views illustrating wrinkles.
Figure 13B:
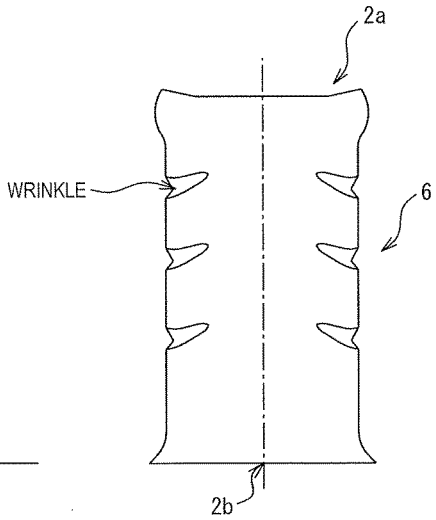

In the forming in this first step, it is preferable that the clearance CL (refer to FIG. 7) be 0.5 times or more to 1.5 times or less the plate thickness of the metal plate 6. When clearance CL becomes less than 0.5 times the plate thickness, the surface of the metal plate 6 is drawn strongly by a side surface of the punch 3 and an inner circumferential surface of the die hole 4*a*, whereby the cracks become prone to occur. Meanwhile, when the clearance CL is increased more than 1.5 times the plate thickness, wrinkles as illustrated in FIGS. 13A and 13B become prone to occur in vicinities of the end portions in the width direction of the metal plate 6 owing to distortion of the plate, which is caused by the shear deformation. Then, in many cases, it is difficult to remove the wrinkles in the second step that is a next step. However, it is not necessary to regulate the entire gap, which goes along the circumferential direction of the punch 3 and the die 4, within the above-described range. Only a clearance in vicinities of at least the end portions in the width direction of the metal plate 6, where the wrinkles as illustrated in FIGS. 13A and 13B are prone to occur, just needs to be set to 0.5 times or more to 1.5 times or less the plate thickness.

Note that the clearance CL is not limited in a case where the wrinkles are allowed to occur in the end portions in the width direction of the metal plate 6, the case including: a case of removing the end portions in the width direction of the metal plate 6 by trimming work in steps on and after the next step; and a case where the end portions in the width direction are not included in a shape of a final product.

In the above description, the case is illustrated as an example, where the profile going along the circumferential direction of the shoulder portion of the die 4 (in particular, the profile of the portion abutting against the metal plate 6) is a circle with the constant curvature radius Rd, and where the profile of the shoulder portion 3*a* of the punch 3 (in particular, the profile of the portion abutting against the metal plate 6) is a circle with a constant curvature radius Rp (Rp=Rd−Cl). However, the profile it not limited to this shape.

For example, the punch 3 just needs to be used, the punch 3 having a shape profile in which, in the shoulder portion 3*a* of the punch 3, the portion against which the center portion of the metal plate 6 abuts and the portions against which the end portions in the width direction of the metal plate 6 abut are offset to each other in the longitudinal direction (X-axis direction), that is, are spaced apart from each other. That is to say, the punch 3 just needs to have an outline shape, in which, in terms of a distance to the shoulder portion 3*a* of the punch 3, the center side portion position in the width direction of the metal plate 6 and end edge portions which abut against the end portions in the plate width direction of the metal plate 6 are spaced apart from each other in the longitudinal direction (X-axis direction), and as the profile of the shoulder portion of the punch 3, such an apart amount from the center side portion position becomes larger as going from the center side portion position toward the end edge portions. Incidentally, it is surmised that the shear deformation to be applies is increased as the apart amount is larger.

As illustrated in FIG. 7, the profile just needs to have such a shape that allows generation of a difference ΔD between a shortest distance Dmin and a longest distance Dmax from the ZY plane to a portion at which the metal plate 6 abuts against the shoulder portion of the punch 3 (hereinafter, the portion is also referred to as a "boundary"). Therefore, the profile of the shoulder portion of the punch 3 may be profiles, each having both of a linear portion and a curved portion as in FIG. 14 and FIG. 15, and may be an ellipsoidal profile as in FIG. 16. Moreover, besides the above, the profile may be parabolic, may have a shape in which pluralities of straight lines and curved lines are combined with one another, or may be S-shaped, W-shaped, polygonal and so on. However, it is preferable to make setting so that the distance in the longitudinal direction from the center side portion can be longer as going from the center side portion toward the end edge portion.

Figure 17:
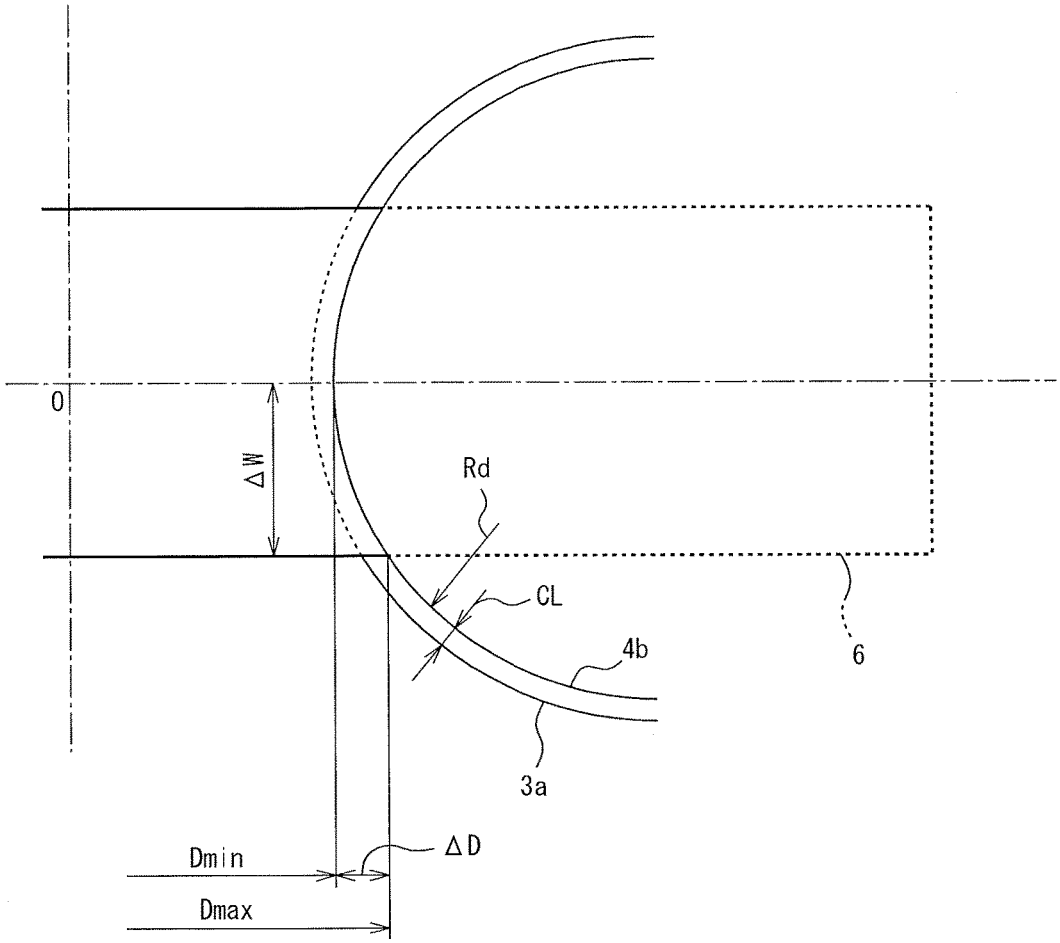
FIG. 17 is a modification example of the profile.

Moreover, as in FIG. 17, the profile may have a shape in which a center axis of a curved line is located on the die 4 side.

Here, when a distance in the plate width direction between respective boundary positions where the shortest distance Dmin and the longest distance Dmax are measured is defined as ΔW (refer to FIG. 17), then it is preferable that a ratio of ΔD and ΔW stay within a range of $0.01 \leq \Delta D/\Delta W \leq 10$. When ΔD/ΔW becomes smaller than 0.01, then ΔD becomes too small with respect to the plate width, and accordingly, it is apprehended that it may become impossible to apply the in-plane shear deformation, which is necessary to form the part shape 1 in the next step, to the metal plate 6. Meanwhile, when $\Delta D/\Delta W$ becomes larger than 10, a region in which a shape of the boundary line is suddenly changed is formed, and accordingly, the metal plate 6 is deformed locally on that region by force beyond the ductility thereof, and the cracks become prone to occur therein. It is more preferable that the ratio of $\Delta D$ and $\Delta W$ stay within a range of $0.1 \leq \Delta D/\Delta W \leq 5$.

Here, in the above-described example of the first step, there is illustrated the case of causing the in-plane shear deformation by the draw forming; however, the processing in the first step is not limited to the draw forming as long as the work is of applying the tensile force between the first loaded portion Fa and the second loaded portions.

"Second Step"

In the second step, after the shear deformation is applied to the metal plate 6 in the first step as in FIGS. 9A and 9B, the metal plate 6 is subjected to the press forming by using a metal die, which corresponds to the target part shape 1, so as to be subjected to bending deformation into the target part shape 1, and is thereby formed into the press-formed part. That is to say, the side wall portions 1B and the flange portions 1C are formed, whereby the metal plate 6 is formed into the part shape 1 bent in the longitudinal direction.

Figure 18:
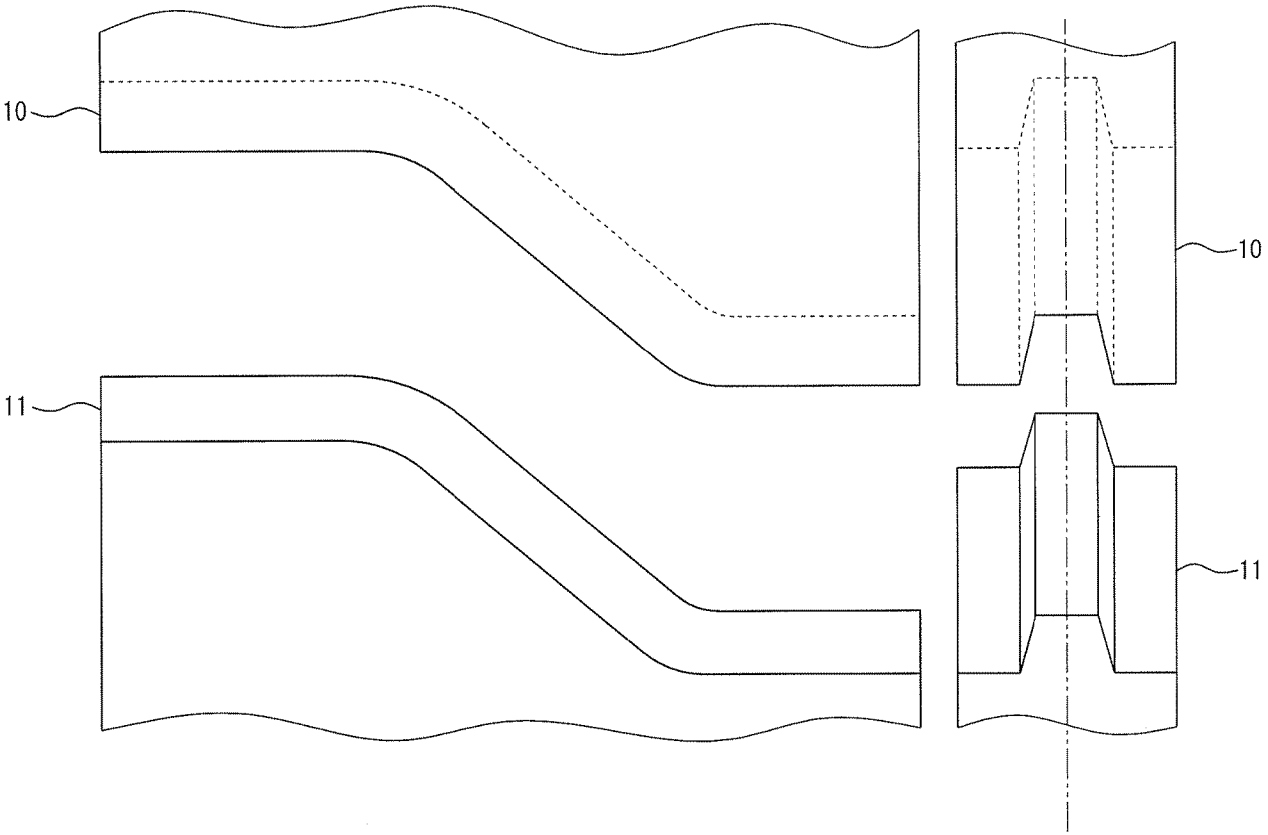
FIG. 18 is a conceptual view illustrating a metal die for use in foam forming in a second step.
Figure 20:
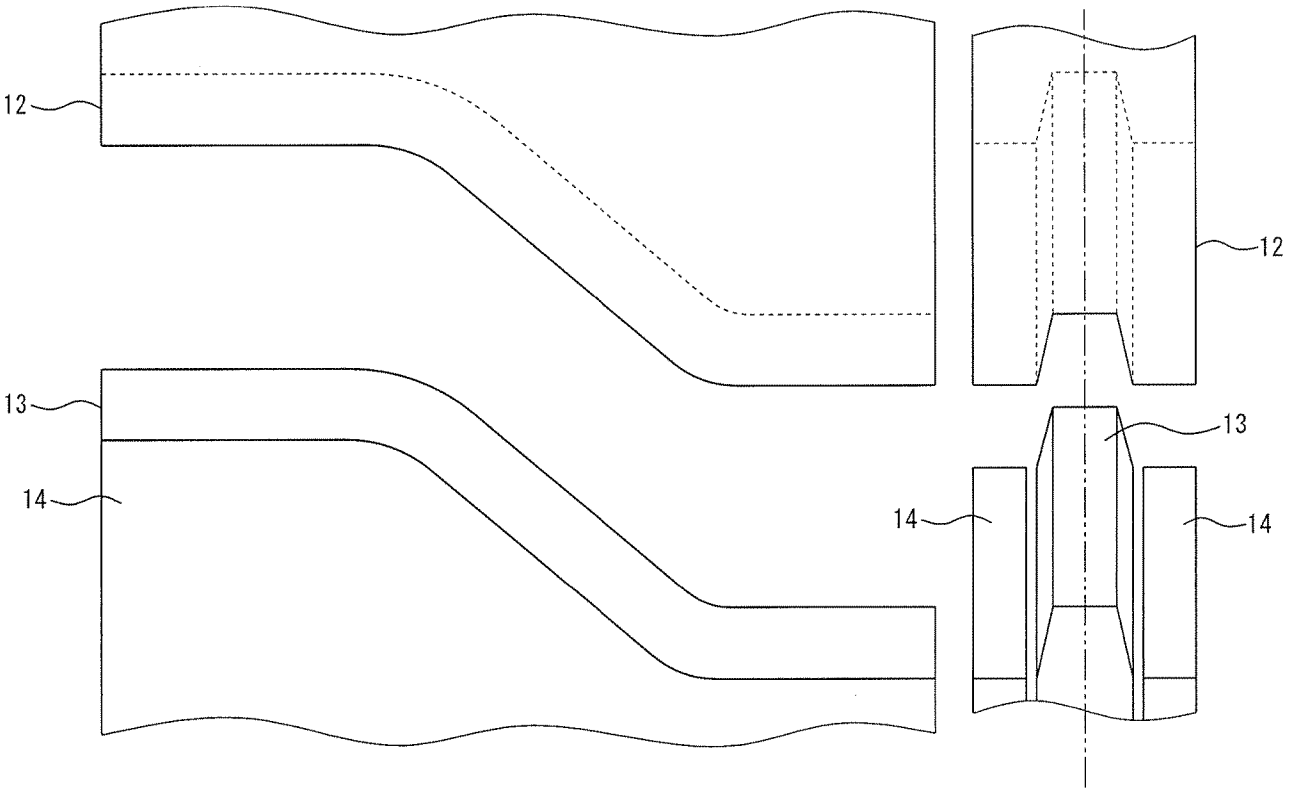
FIG. 20 is a conceptual view illustrating a metal die for use in draw forming in the second step.

How to apply the bending deformation in the press forming in this second step is not particularly limited; however, it is preferable to use metal dies 10 and 11 for the foam forming as a general press forming method, which are illustrated in FIG. 18, and metal dies 12 to 14 for the draw forming as a general press forming method, which are illustrated in FIG. 20, and to use a cam mechanism.

Here, in FIG. 18, reference numeral 10 denotes a die, and reference numeral 11 denotes a punch. In FIG. 20, reference numeral 12 denotes a die, reference numeral 13 denotes a punch, and reference numeral 14 denotes wrinkle holders.

Moreover, a pad can also be used for the purpose of further suppressing the occurrence of the wrinkles in the top surface portion 1A and fixing the press-formed part. That is to say, the press forming may be implemented to manufacture the press-formed part in a state where a portion that becomes the top surface portion 1A is sandwiched and restrained by a head of the punch and the pad.

Moreover, for example, a width of a punch bottom and a height of the side wall portions 1B jut need to be set to ¼ of the plate width W of the metal plate 6, an angle of the side wall portions 1B just needs to be 80°, and the plate thickness of the clearance CL just needs to be set the same as the plate thickness.

Figure 19:
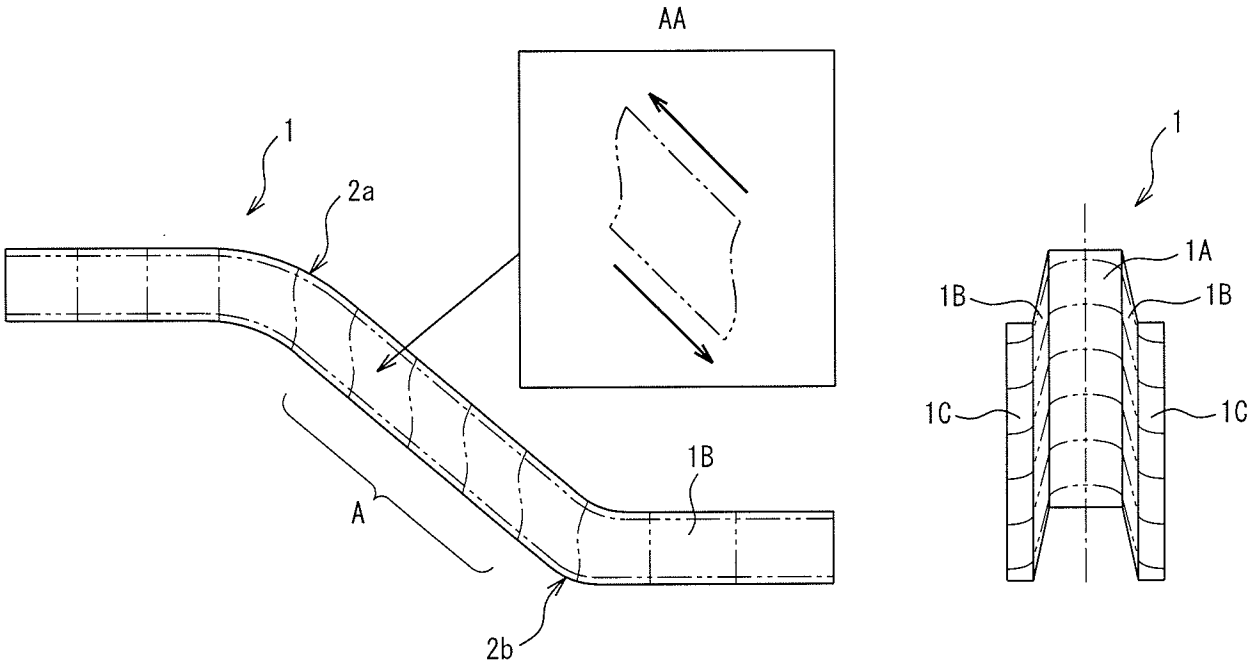
FIG. 19 is a view illustrating a forming state in the second step.

In the forming using the metal dies in the second step, as illustrated in FIG. 19, the part shape 1 bent in the longitudinal direction was able to be obtained without the occurrence of the cracks and the wrinkles, and it was able to be confirmed that the position of the metal plate 6 in which the in-plane shear deformation occurred in the first step was located on the side wall portion A.

By the in-plane shear deformation applied in the first step in advance, the excess and shortage of the metal plate 6, which occur on the periphery of the side wall portion A after the second step, are suppressed to be small. Therefore, it is not necessary for the metal dies to perform a complicated structure as a forming metal die for the second step, and the metal dies may be draw forming metal dies as in FIG. 20 as well as the foam forming metal dies.

Note that, in order to fabricate the part shape 1, which has the U-shaped cross-sectional shape and is bent in the longitudinal direction, a total length of the height of the side wall portions and the width of the punch bottom portion in the metal die in the second step just needs to be made longer than the plate width W of the metal plate 6.

Here, in the second step, it is not necessary to implement the bending forming for the target part shape 1 at the same timing. For example, the bending may be implemented while shifting pieces of processing timing for the respective bent portions such that the first bent portion 2*a* that protrudes is first subjected to the bending processing, and then the bending processing is implemented for the second bent portion 2*b* that is recessed so as to bend the second bent portion 2*b* concerned.

The pieces of timing are shifted from each other as described above, whereby a flow of the material becomes smooth, and accuracy of the final shape is enhanced.

(Modification Example)

Figure 21A:
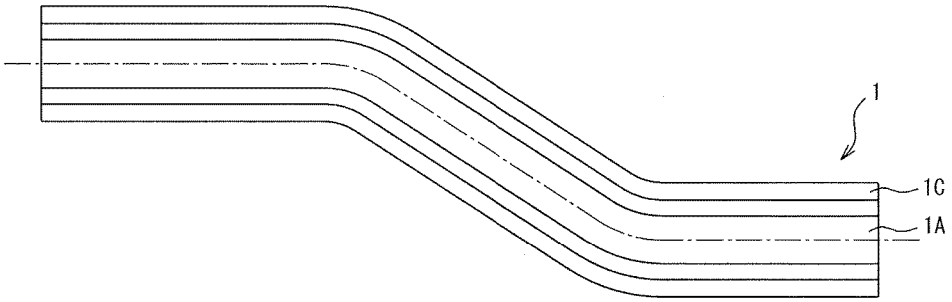
FIGS. 21A and 21B are views explaining a modification example.

In the above, the description is made of the case of the metal die shape symmetric with respect to the XZ plane in the first step; however, a metal die shape asymmetric with respect to the XZ plane may be used. In this case, it is possible to cope with a case where the top surface portion 1A is bent into an S shape or the like in the plate width direction along the longitudinal direction as illustrated in FIG. 21A.

Figure 21B:
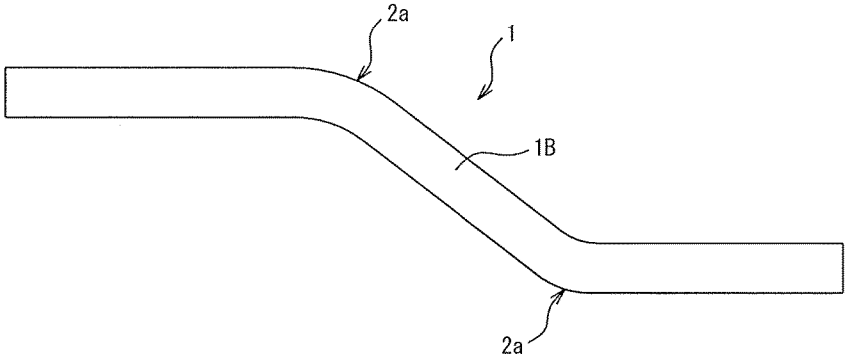

That is to say, in a case of using the asymmetric metal die, by the first step, in-plane shear deformation asymmetric with respect to the XZ plane occurs in the side wall portions 1B and top surface portion 1A of the metal plate. Therefore, in a case of implementing the press forming for that metal plate in the second step, there is exerted such an effect that it becomes easy to form the metal plate into a part shape twisted in the longitudinal direction as in FIGS. 21A and 21B. This is because, in a case of a part of FIGS. 21A and 21B, the excess and shortage of the length of the metal plate, which are necessary to suppress the cracks and the wrinkles, differ between the left and right side wall portions 1B continuous with the top surface portion 1A. The above-described asymmetric metal die just needs to be set in response to the excess and shortage.

Moreover, at this time, in the first step, the in-plane shear deformation corresponding to the bending in the width direction may also be applied to the top surface portion 1A in advance.

(Effects of this Embodiment)

(1) The method of this embodiment is a press forming method for forming a metal plate 6 into the part shape 1 having at least the top surface portion 1A and the side wall portions 1B continuous with both left and right sides of the top surface portion 1A, the part shape 1 having the U-shaped cross section and having the one or two or more bent portions 2*a* and 2*b* bent in the longitudinal direction that is the direction intersecting the cross section. The method of this embodiment includes: the first step of applying the in-plane shear deformation to the plate portion on both sides or one side of the bent portions 2*a* and 2*b* in the longitudinal direction of the metal plate 6, the in-plane shear deformation corresponding to the direction of bending the portion of the part shape; and the second step of implementing the press forming for the metal plate into the part shape 1, the metal plate to which the in-plane shear deformation has been applied.

In accordance with this configuration, the in-plane shear deformation that goes along the bending direction is applied to the metal plate 6 in the first step, and thereafter, the press forming is implemented for the part shape 1 as a target in the second step, whereby the press-formed part is manufactured.

The in-plane shear deformation is applied in advance, whereby the excessive movement of the material in the bent portions 2*a* and 2*b* is suppressed. As a result, it becomes possible to suppress the occurrence of the cracks and the wrinkles in the event of forming the metal plate 6 into the part shape having the cross-sectional shape such as the U shape and the hat shape and having the bent portions 2*a* and 2*b* in the longitudinal direction intersecting the cross section.

(2) In a case where the bent portions 2*a* and 2*b* of the part shape 1 are bent so that the top surface portion 1A can protrude or be recessed, the in-plane shear deformation by the first step is applied to the plate portions which become the side wall portions 1B.

In a case of bending the metal plate 6 in the plate thickness direction of the top surface portion 1A, the excess and shortage of the length of the metal plate 6 occur mainly in the side wall portions.

In accordance with this configuration, the in-plane shear deformation is applied in advance to the side wall portions where the excess and shortage of the length occur, whereby it becomes possible to suppress the occurrence of the cracks and the wrinkles in the event of forming the metal plate 6 into the shape having the cross-sectional shape such as the U shape and the hat shape and having the bent portions 2*a* and 2*b* in the longitudinal direction intersecting the cross section.

(3) In a case where the part shape 1 has two or more bent portions 2*a* and 2*b* in the longitudinal direction, the in-plane shear deformation is applied between the bent portions 2*a* and 2*b* adjacent to each other in the first step.

In accordance with this configuration, the above-described in-plane shear deformation is applied between the bent portions 2*a* and 2*b* adjacent to each other, whereby it becomes possible to suppress the occurrence of the cracks and the wrinkles in the bent portions at two spots.

(4) In the first step, the draw forming is implemented for the metal plate 6 to cause the shear deformation so that the tensile force can be generated between the first loaded portion Fa located on the top surface portion 1A and the second loaded portion Fb apart from the first loaded portion Fa in the longitudinal direction and located on the side wall portions 1B or the plate portions outside of the side wall portions 1B in the plate width direction.

In accordance with this configuration, the tensile force can be inputted in the direction inclined with respect to such a plate longitudinal direction, and it becomes possible to apply the in-plane shear deformation.

(5) The profile of the shoulder portion 3*a* of the punch 3 for use in the draw forming has the outline shape in which the center side portion abutting against the center side portion position in the plate width direction of the metal plate 6 and the end edge portion abutting against the end portion in the plate width direction of the metal plate 6 are spaced apart from each other in the longitudinal direction, and the apart amount from the center side portion becomes larger as going from the center side portion toward the end edge portion.

Note that a profile shape of the die hole 4*a* is also set to the same shape as a profile shape of the shoulder portion of the punch 3.

In accordance with this configuration, it becomes possible to apply the necessary shear deformation while bending the bent portions 2*a* and 2*b*.

(6) $0.01 \leq \Delta D/\Delta W \leq 10$ is satisfied in the case where the apart amount between the center side portion and the end edge portion is defined as $\Delta D$, and the distance in the plate width direction between the center side portion and the end edge portion is defined as $\Delta W$.

When the ratio stays within this range, it becomes possible to apply the shear deformation.

(7) The gap between the punch 3 and the die 4, which are used in the first step, is set to 0.5 times or more to 1.5 times or less the plate thickness of the metal plate 6.

In accordance with this configuration, it becomes possible to reduce or suppress the wrinkles which occur in the plate width end portion due to the draw forming.

(8) The profile of the shoulder portion 3*a* of the punch 3 includes the parallel portion on the center side in the plate width direction of the metal plate 6, the parallel portion being extended in the plate width direction of the metal plate 6, and the center side portion is located on an end portion of the parallel portion.

In accordance with this configuration, it becomes possible to reduce the application of the tensile force to the center side portion in the plate width direction, and it becomes possible to effectively suppress the occurrence of the wrinkles on the center side in the width direction.

(9) In the profile of the shoulder portion 3*a* of the punch 3, the profile between the center side portion and the end edge portion is formed linear or circular-arc.

In accordance with this configuration, it becomes possible to apply the in-plane shear force.

(10) The parallel portion abuts against the position of the metal plate 6, which becomes the top surface portion 1A.

In accordance with this configuration, it becomes possible to reduce the application of the tensile force to the top surface portion 1A, and it becomes possible to effectively suppress the occurrence of the wrinkles on the top surface portion 1A.

(11) In the second step, the plate material to which the in-plane shear deformation has been applied is subjected to the press forming into the part shape 1 by using the foam forming or the draw forming.

In such a way, it becomes possible to form the metal plate 6 into the target part shape 1.

(12) In the second step, the position that becomes the top surface portion 1A in the metal plate 6 is restrained from moving during the forming by sandwiching the position that becomes the top surface portion 1A in the metal plate 6 by a pad and the punch 3.

In such a way, it becomes possible to suppress the occurrence of the wrinkles in the top surface portion 1A more surely.

(13) The bent portions 2*a* and 2*b* of the target part shape 1 includes the bent portions 2*a* and 2*b* in which the top surface portion 1A protrudes and the bent portions 2*a* and 2*b* in which the top surface portion 1A is recessed, and in the second step, the portion between the bent portions 2*a* and 2*b* adjacent to each other is divided into the plurality of regions in the longitudinal direction, and timing of bending the plurality of regions is changed.

In accordance with this configuration, it becomes possible to press-form the metal plate 6 into the target part shape 1 more surely.

For example, the forming of the bent portions 2*a* and 2*b* which protrude and the forming of the bent portions 2*a* and 2*b* which are recessed are implemented while shifting the timing thereof from each other, whereby it becomes possible to perform more accurate processing.

EXAMPLE

Next, a description is made of an example of the press forming of the above-described embodiment, which is based on the present invention. Note that the present invention is not limited to this example.

"Applied Material"

As the metal plate 6, metal plates such as high-tensile steel plates and aluminum alloy plates with a tensile strength of 590 MPa or more, which are poor in ductility and Lankford value, were used.

Specifically, as illustrated in Table 1, as the metal plate 6, there were used a 590 MPa-class steel plate and a 1180 MPa-class steel plate.

TABLE 1

| Symbol | Steel Type | Plate thickness (mm) | YP (MPa) | TS (MPa) | E1 (%) | r value |
|---|---|---|---|---|---|---|
| 590 | 590 MPa-Class Steel Plate | 1.0 | 396 | 610 | 30 | 0.97 |

TABLE 1-continued

| Symbol | Steel Type | Plate thickness (mm) | YP (MPa) | TS (MPa) | E1 (%) | r value |
|---|---|---|---|---|---|---|
| 1180 | 1180 MPa-Class Steel Plate | 1.0 | 950 | 1203 | 9 | 0.90 |

The target part was defined to have the part shape 1 bent in the longitudinal direction in FIG. 1, in which dimensions of the metal plate 6 were set as: the width W equal to 300 mm; the length L equal to 800 mm; and the plate thickness equal to 1.0 mmt.

Then, forming methods in invention examples based on the present invention and in comparison examples for comparison and evaluation results (forming possibilities) thereof are individually illustrated in Table 2 and Table 3.

TABLE 2

| No. | Material | Forming method: CL with respect to plate thickness | First step | Second step | Forming possibility ◎ > ○ > Δ > X | | Remarks |
|---|---|---|---|---|---|---|---|
| 1 | 590 | 1.0 time | Conventional method (draw forming) | | X | crack occurred | comparative example |
| 2 | 590 | 1.0 time | Conventional method (foam forming) | | Δ | wrinkle occurred | comparative example |
| 3 | 590 | 0.4 times | ΔD/ΔW = 0.009 | not implemented | X | crack occurred | comparative example |
| 4 | 590 | 0.4 times | ΔD/ΔW = 0.01 | not implemented | X | crack occurred | comparative example |
| 5 | 590 | 0.4 times | ΔD/ΔW = 0.1 | not implemented | X | crack occurred | comparative example |
| 6 | 590 | 0.4 times | ΔD/ΔW = 5 | not implemented | X | crack occurred | comparative example |
| 7 | 590 | 0.4 times | ΔD/ΔW = 10 | not implemented | X | crack occurred | comparative example |
| 8 | 590 | 0.4 times | ΔD/ΔW = 11 | not implemented | X | crack occurred | comparative example |
| 9 | 590 | 0.5 times | ΔD/ΔW = 0.009 | not implemented | X | crack occurred | comparative example |
| 10 | 590 | 0.5 times | ΔD/ΔW = 0.01 | foam forming | ○ | no crack or wrinkle | invention example |
| 11 | 590 | 0.5 times | ΔD/ΔW = 0.1 | foam forming | ◎ | no crack or wrinkle | invention example |
| 12 | 590 | 0.5 times | ΔD/ΔW = 5 | foam forming | ◎ | no crack or wrinkle | invention example |
| 13 | 590 | 0.5 times | ΔD/ΔW = 10 | foam forming | ○ | no crack or wrinkle | invention example |
| 14 | 590 | 0.5 times | ΔD/ΔW = 11 | not implemented | X | crack occurred | comparative example |
| 15 | 590 | 1.0 time | ΔD/ΔW = 0.009 | not implemented | X | crack occurred | comparative example |
| 16 | 590 | 1.0 time | ΔD/ΔW = 0.01 | foam forming | ○ | no crack or wrinkle | invention example |
| 17 | 590 | 1.0 time | ΔD/ΔW = 0.1 | foam forming | ◎ | no crack or wrinkle | invention example |
| 18 | 590 | 1.0 time | ΔD/ΔW = 5 | foam forming | ◎ | no crack or wrinkle | invention example |
| 19 | 590 | 1.0 time | ΔD/ΔW = 10 | foam forming | ○ | no crack or wrinkle | invention example |
| 20 | 590 | 1.0 time | ΔD/ΔW = 11 | not implemented | X | crack occurred | comparative example |
| 21 | 590 | 1.5 times | ΔD/ΔW = 0.009 | not implemented | X | crack occurred | comparative example |
| 22 | 590 | 1.5 times | ΔD/ΔW = 0.01 | foam forming | ○ | no crack or wrinkle | invention example |
| 23 | 590 | 1.5 times | ΔD/ΔW = 0.1 | foam forming | ◎ | no crack or wrinkle | invention example |
| 24 | 590 | 1.5 times | ΔD/ΔW = 5 | foam forming | ◎ | no crack or wrinkle | invention example |
| 25 | 590 | 1.5 times | ΔD/ΔW = 10 | foam forming | ○ | no crack or wrinkle | invention example |

TABLE 2-continued

| No. | Material | CL with respect to plate thickness | Forming method: First step | Forming method: Second step | Forming possibility ◎ > ○ > Δ > X | | Remarks |
|---|---|---|---|---|---|---|---|
| 26 | 590 | 1.5 times | ΔD/ΔW = 11 | not implemented | X | crack occurred | comparative example |
| 27 | 590 | 1.6 times | ΔD/ΔW = 0.009 | not implemented | X | crack occurred | comparative example |
| 28 | 590 | 1.6 times | ΔD/ΔW = 0.01 | not implemented | X | crack occurred | comparative example |
| 29 | 590 | 1.6 times | ΔD/ΔW = 0.1 | not implemented | X | crack occurred | comparative example |
| 30 | 590 | 1.6 times | ΔD/ΔW = 5 | not implemented | X | crack occurred | comparative example |
| 31 | 590 | 1.6 times | ΔD/ΔW = 10 | not implemented | X | crack occurred | comparative example |
| 32 | 590 | 1.6 times | ΔD/ΔW = 11 | not implemented | X | crack occurred | comparative example |

TABLE 3

| No. | Material | CL with respect to plate thickness | Forming method: First step | Forming method: Second step | Forming possibility ◎ > ○ > Δ > X | | Remarks |
|---|---|---|---|---|---|---|---|
| 33 | 1180 | 1.0 time | Conventional method (draw forming) | | X | crack occurred | comparative example |
| 34 | 1180 | 1.0 time | Conventional method (foam forming) | | X | no crack or wrinkle | comparative example |
| 35 | 1180 | 0.4 times | ΔD/ΔW = 0.009 | not implemented | X | crack occurred | comparative example |
| 36 | 1180 | 0.4 times | ΔD/ΔW = 0.01 | not implemented | X | crack occurred | comparative example |
| 37 | 1180 | 0.4 times | ΔD/ΔW = 0.1 | not implemented | X | crack occurred | comparative example |
| 38 | 1180 | 0.4 times | ΔD/ΔW = 5 | not implemented | X | crack occurred | comparative example |
| 39 | 1180 | 0.4 times | ΔD/ΔW = 10 | not implemented | X | crack occurred | comparative example |
| 40 | 1180 | 0.4 times | ΔD/ΔW = 11 | not implemented | X | crack occurred | comparative example |
| 41 | 1180 | 0.5 times | ΔD/ΔW = 0.009 | not implemented | X | crack occurred | comparative example |
| 42 | 1180 | 0.5 times | ΔD/ΔW = 0.01 | foam forming | ○ | no crack or wrinkle | invention example |
| 43 | 1180 | 0.5 times | ΔD/ΔW = 0.1 | foam forming | ◎ | no crack or wrinkle | invention example |
| 44 | 1180 | 0.5 times | ΔD/ΔW = 5 | foam forming | ◎ | no crack or wrinkle | invention example |
| 45 | 1180 | 0.5 times | ΔD/ΔW = 10 | foam forming | ○ | no crack or wrinkle | invention example |
| 46 | 1180 | 0.5 times | ΔD/ΔW = 11 | not implemented | X | crack occurred | comparative example |
| 47 | 1180 | 1.0 time | ΔD/ΔW = 0.009 | not implemented | X | crack occurred | comparative example |
| 48 | 1180 | 1.0 time | ΔD/ΔW = 0.01 | foam forming | ○ | no crack or wrinkle | invention example |
| 49 | 1180 | 1.0 time | ΔD/ΔW = 0.1 | foam forming | ◎ | no crack or wrinkle | invention example |
| 50 | 1180 | 1.0 time | ΔD/ΔW = 5 | foam forming | ◎ | no crack or wrinkle | invention example |
| 51 | 1180 | 1.0 time | ΔD/ΔW = 10 | foam forming | ○ | no crack or wrinkle | invention example |
| 52 | 1180 | 1.0 time | ΔD/ΔW = 11 | not implemented | X | crack occurred | comparative example |
| 53 | 1180 | 1.5 times | ΔD/ΔW = 0.009 | not implemented | X | crack occurred | comparative example |
| 54 | 1180 | 1.5 times | ΔD/ΔW = 0.01 | foam forming | ○ | no crack or wrinkle | invention example |
| 55 | 1180 | 1.5 times | ΔD/ΔW = 0.1 | foam forming | ◎ | no crack or wrinkle | invention example |

TABLE 3-continued

| No. | Material | CL with respect to plate thickness | Forming method: First step | Forming method: Second step | Forming possibility ◎ > ○ > Δ > X | | Remarks |
|---|---|---|---|---|---|---|---|
| 56 | 1180 | 1.5 times | ΔD/ΔW = 5 | foam forming | ◎ | no crack or wrinkle | invention example |
| 57 | 1180 | 1.5 times | ΔD/ΔW = 10 | foam forming | ○ | no crack or wrinkle | invention example |
| 58 | 1180 | 1.5 times | ΔD/ΔW = 11 | not implemented | X | crack occurred | comparative example |
| 59 | 1180 | 1.6 times | ΔD/ΔW = 0.009 | not implemented | X | crack occurred | comparative example |
| 60 | 1180 | 1.6 times | ΔD/ΔW = 0.01 | not implemented | X | crack occurred | comparative example |
| 61 | 1180 | 1.6 times | ΔD/ΔW = 0.1 | not implemented | X | crack occurred | comparative example |
| 62 | 1180 | 1.6 times | ΔD/ΔW = 5 | not implemented | X | crack occurred | comparative example |
| 63 | 1180 | 1.6 times | ΔD/ΔW = 10 | not implemented | X | crack occurred | comparative example |
| 64 | 1180 | 1.6 times | ΔD/ΔW = 11 | not implemented | X | crack occurred | comparative example |

The evaluation of the formed articles were visually performed, and the results were evaluated in four stages, which are "◎", "○", "Δ", and "×".

Specifically, a case where the cracks occurred was evaluated as "×", a case where the cracks did not occur but significant wrinkles occurred was evaluated as "Δ", a case where no cracks or wrinkles occurred was evaluated as "○", and a case where no cracks or wrinkles occurred and an excellent exterior appearance was brought particularly was evaluated as "◎". Note that, in a case where the cracks occurred in the first step, the evaluation was determined to be "×", and the second step was not implemented.

Figure 14:
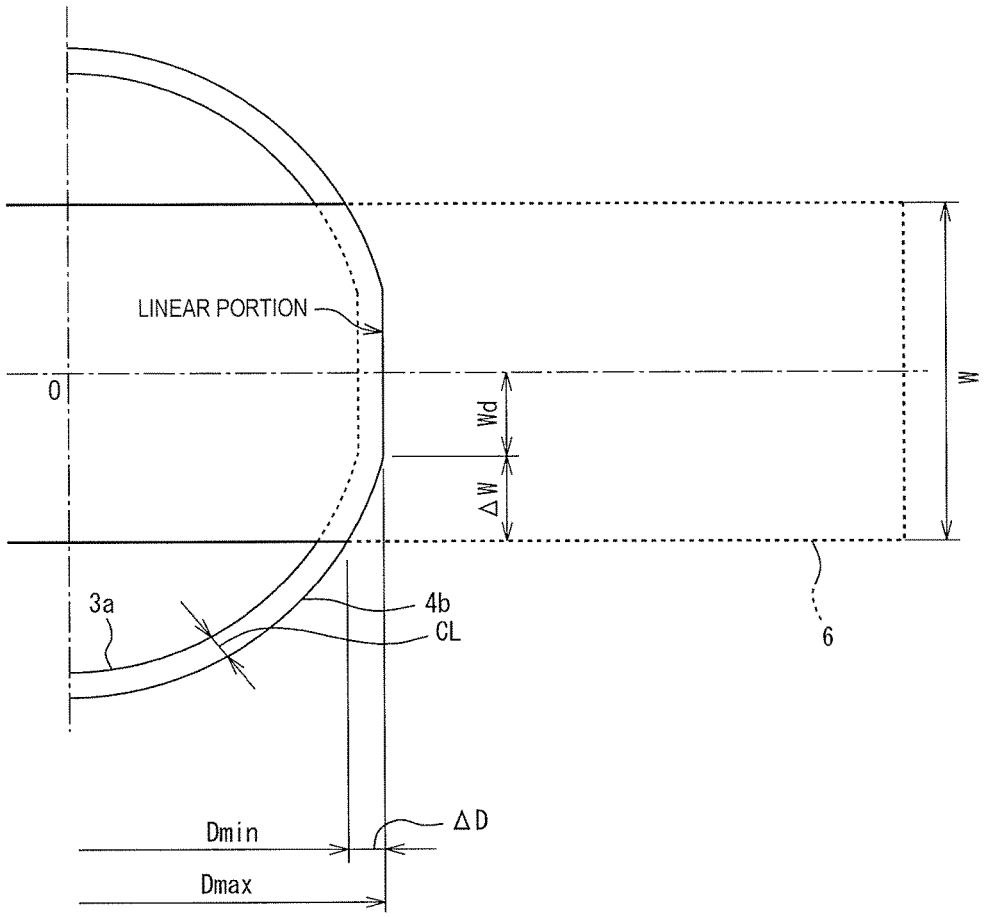
FIG. 14 is a modification example of the profile.

Here, each of the comparative examples illustrates the case of implementing, in only the single step, the press forming for the formed article formed by the draw forming or the foam forming, and each of the invention examples illustrates the case of obtaining the target formed article by performing the first step by the metal die illustrated in FIGS. 10A and 10B and implementing the second step by the metal die illustrated in FIG. 14.

With regard to the metal die for the first step of FIG. 14, it is preferable that a distance Wd of the linear portion stay within a range of 0≤Wd<plate width W. A metal die in a case where Wd is equal to 0 is the same as the metal die in FIG. 6. In a case where Wd is equal to the plate width W, then ΔD becomes equal to 0, and accordingly, the in-plane shear deformation stops occurring in the metal plate 6. Moreover, in a case where the top surface portion 1A of the target part is flat, it is preferable that the width of the top surface portion 1A and Wp be set equal to each other so that the center portion of the metal plate 6 already formed by the first step can be flat.

As understood from Tables 2 and 3, while the cracks or the wrinkles are prone to occur in the comparative examples, the cracks or the wrinkles do not occur in the invention examples.

Figure 15:
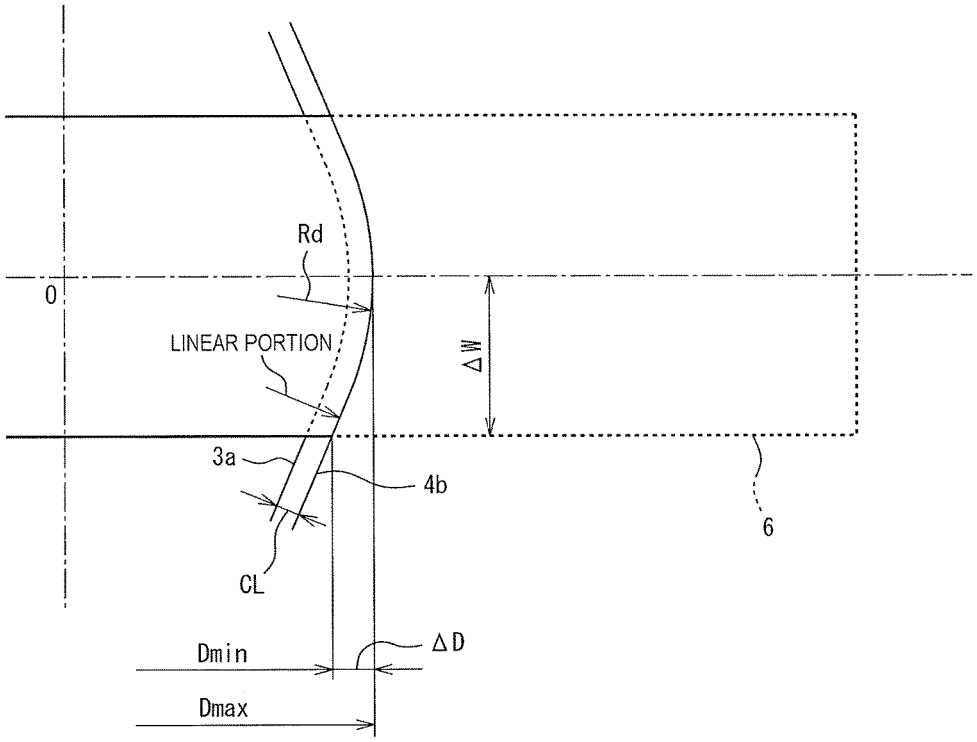
FIG. 15 is a modification example of the profile.
Figure 16:
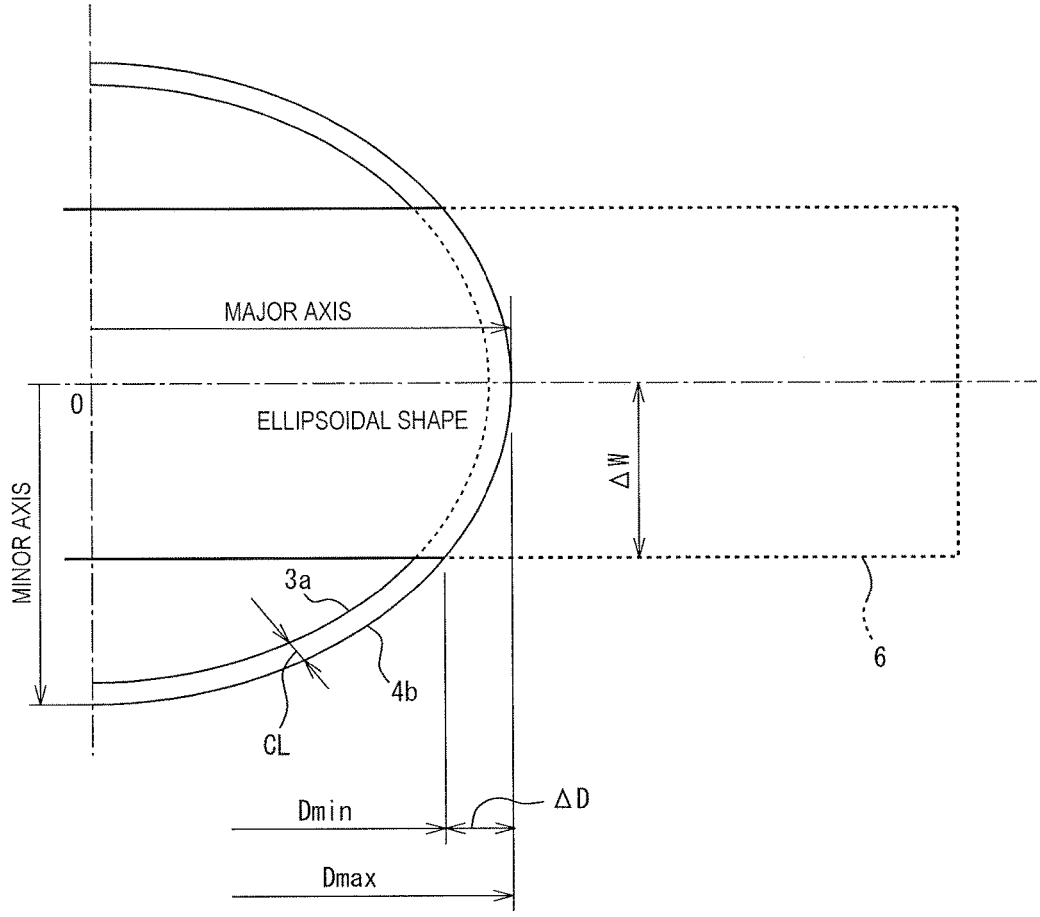
FIG. 16 is a modification example of the profile.

Here, the processing of the first step was implemented also in the metal dies of FIG. 15, FIG. 16 and FIG. 17, and as results thereof, results similar to those in Table 2 and Table 3 were obtained.

The entire contents of Japanese Patent Application No. 2013-263993 (filed on Dec. 20, 2013), of which this application claims priority, form a part of the present disclosure by reference.

Here, the description is made while referring to the limited number of embodiments; however, the scope or rights is not limited to these, and for those skilled in the art, modifications of the respective embodiments, which are based on the above-described disclosure, are obvious.

REFERENCE SIGNS LIST

1 part shape
1A top surface portion
1B side wall portion
1C flange portion
2*a* first bent portion (protruding portion)
2*b* second bent portion (recessed portion)
3 punch
3*a* shoulder portion
4 die
4*a* die hole
4*b* shoulder portion
6 metal plate
CL clearance
Dmax longest distance
Dmin shortest distance
Fa first loaded portion
Fb second loaded portion

The invention claimed is:

1. A press forming method for forming a metal plate into a part shape, the part shape having:

at least a top surface portion and side wall portions that are continuous with the top surface portion, a U-shaped or hat-shaped cross section, and one or more bent portions that are bent in a longitudinal direction of the metal plate, the press forming method comprising:

a first step of applying in-plane shear deformation to a metal plate portion on either (i) a first side of the metal plate or (ii) the first side and a second side of the metal plate, the in-plane shear deformation being applied in the longitudinal direction of the metal plate, and a second step of applying press forming on the metal plate, after the first step, and forming the part shape, the press forming being applied on the first side and the second side of the metal plate, wherein:

in the first step, the in-plane shear deformation is caused by applying tensile force between a first loaded portion and a second loaded portion and is caused by draw forming by a punch, the first loaded portion corresponding to the top surface portion of the part shape, and the second loaded portion being spaced apart from the first loaded portion in the longitudinal direction and corresponding to at least one of the side wall portions of the part shape or on a portion of the part shape that is outside of the side wall portions in a width direction of the part shape, a profile of a shoulder portion of the punch for use in the draw forming, the profile going along a circumferential direction of the punch, has an outline shape in which a center side portion, which abuts against a center portion side position in the plate width direction of the metal plate, and an end edge portion, which abuts against an end portion in the plate width direction of the metal plate, are spaced apart from each other in the longitudinal direction such that a spacing between the center side portion and the end edge portion becomes larger when going from the center side portion toward the end edge portion, and a profile of a shoulder portion of a die for use in the draw forming has an outline shape similar to the profile of the shoulder portion of the punch.

2. The press forming method according to claim 1, wherein, in the second step:

the one or more bent portions are formed so that the top surface portion either protrudes or is recessed, and the first side of the metal plate and the second side of the metal plate become the side wall portions.

3. The press forming method according to claim 1, wherein:

the part shape has two or more bent portions that are spaced apart from each other in the longitudinal direction, and the in-plane shear deformation of the first step is applied between first and second positions, the first and second positions corresponding to the one or more bent portions of the part shape.

4. The press forming method according to claim 1, wherein $0.01<\Delta D/\Delta W<10$ is satisfied in a case where the spacing between the center side portion and the end edge portion is defined as $\Delta D$, and a distance in the plate width direction between the center side portion and the end edge portion is defined as $\Delta W$.

5. The press forming method according to claim 1, wherein a gap between the punch and a hole of the die, which are used in the first step, is set to 0.5 times or more to 1.5 times or less a plate thickness of the metal plate.

6. The press forming method according to claim 1, wherein the profile of the shoulder portion of the punch includes a parallel portion on a center side in the plate width direction of the metal plate, the parallel portion being extended in the plate width direction of the metal plate, and the center side portion is located on an end portion of the parallel portion.

7. The press forming method according to claim 6, wherein, in the profile of the shoulder portion of the punch, a profile between the center side portion and the end edge portion is formed linear or circular-arc.

8. The press forming method according to claim 6, wherein the parallel portion abuts against a metal plate position that becomes the top surface portion.

9. The press forming method according to claim 1, wherein, in the second step, the press forming includes using foam forming or draw forming to form the part shape.

10. The press forming method according to claim 9, wherein, in the second step during the foam forming or the draw forming, a first position is restrained from moving and a second position is sandwiched by a pad and a punch, the first position and the second position both corresponding to the top surface portion of the part shape.

11. The press forming method according to claim 9, wherein:

the one or more bent portions of the part shape include a first bent portion, in which the top surface portion protrudes, and a second bent portion, in which the top surface portion is recessed.

* * * * *